United States Patent [19]

Sauseng et al.

[11] 3,989,978

[45] Nov. 2, 1976

[54] COUPLED CAVITY TRAVELING-WAVE TUBE WITH OBLONG CAVITIES FOR INCREASED BANDWIDTH

[75] Inventors: Otto Sauseng, Rolling Hills Estates; Kenneth A. Estrella, Torrance, both of Calif.

[73] Assignee: Hughes Aircraft Company, Culver City, Calif.

[22] Filed: Feb. 20, 1976

[21] Appl. No.: 659,811

[52] U.S. Cl. ..... 315/3.5; 315/39.3; 330/43; 333/31 A

[51] Int. Cl.[2] ..... H01J 25/34

[58] Field of Search ..... 315/3.5, 3.6, 39.3; 333/31 A; 330/43

[56] References Cited

UNITED STATES PATENTS

| | | | |
|---|---|---|---|
| 2,985,791 | 5/1961 | Bates et al. | 315/3.5 |
| 3,181,023 | 4/1965 | Hant et al. | 315/3.5 |
| 3,383,620 | 5/1968 | Forster | 315/3.5 X |
| 3,514,662 | 5/1970 | Eldredge | 315/3.5 |

*Primary Examiner*—Saxfield Chatmon, Jr.
*Attorney, Agent, or Firm*—Paul M. Coble; W. H. MacAllister

[57] ABSTRACT

A coupled cavity traveling-wave tube is disclosed wherein each interaction cavity has an oblong configuration in a plane perpendicular to the tube axis. The oblong cavities have a length-to-width ratio of a predetermined value between about 1.2 and 1.6, preferably being about 1.5. Coupling apertures in the end walls separating adjacent interaction cavities extend circumferentially about half way around aligned circular electron beam holes along the tube axis, with the circumferential extremities of the coupling apertures lying substantially parallel to the length of the oblong interaction cavities.

6 Claims, 4 Drawing Figures

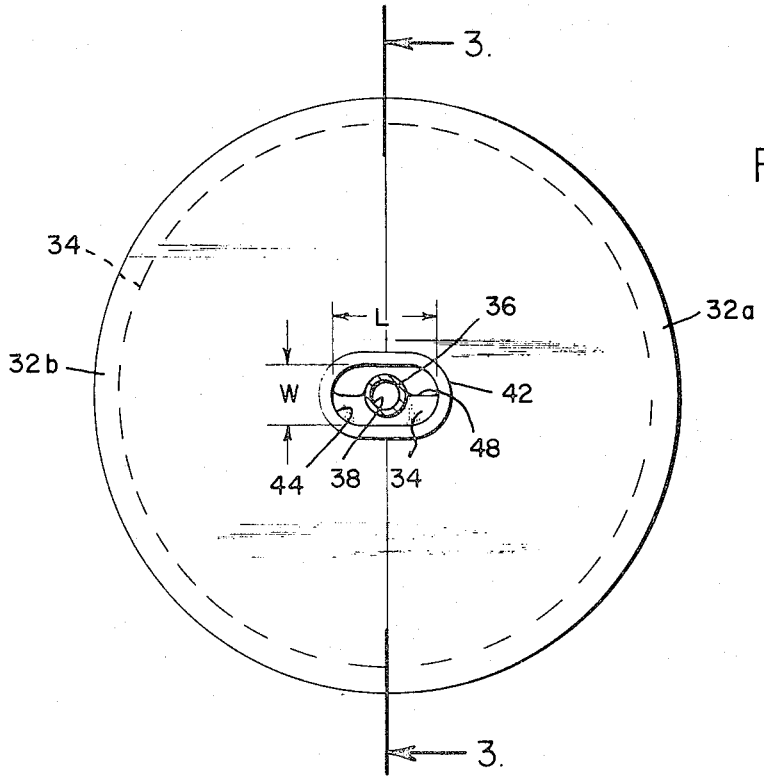
Fig. 2.
Fig. 3.
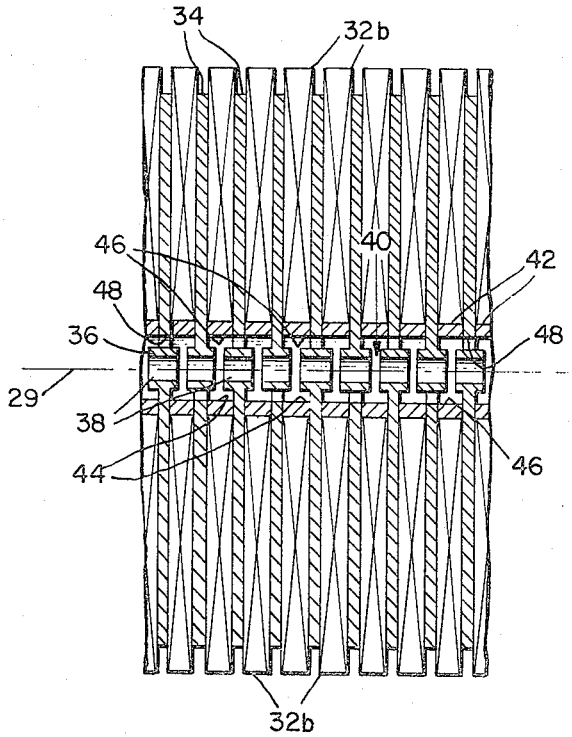
Fig. 4.
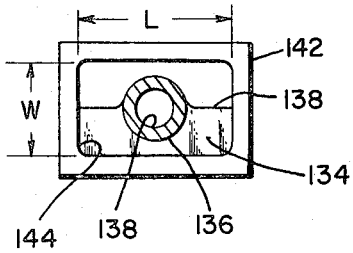

COUPLED CAVITY TRAVELING-WAVE TUBE WITH OBLONG CAVITIES FOR INCREASED BANDWIDTH

This invention relates generally to travelling-wave tubes, and more particularly relates to an improved coupled cavity slow-wave structure for wide bandwidth traveling-wave tubes.

In traveling-wave tubes a beam of electrons is caused to interact with a propagating electromagnetic wave in a manner which amplifies the electromagnetic energy. In order to achieve such interaction, the electromagnetic wave is propagated along a slow-wave structure, such as a conductive helix would about the path of the electron beam or a folded waveguide type of structure in which a waveguide is effectively would back and forth across the path of the electrons. The slow-wave structure provides a path of propagation for the electromagnetic wave which is considerably longer than the axial length of the structure, and hence, the traveling wave may be made to effectively propagate at nearly the velocity of the electron beam. Interaction between the electrons in the beam and the traveling wave causes velocity modulation and bunching of the electrons in the beam. The net result may then be a transfer of energy from the electron beam to the wave traveling along the slow-wave structure.

The present invention is concerned with traveling-wave tubes utilizing slow-wave structures of the coupled cavity, or interconnected cell, type. In this type of slow-wave structure a series of interaction cells, or cavities, are disposed adjacent to each other sequentially along the axis of the tube. The electron beam passes axially through each interaction cavity, and electromagnetic coupling is provided between each cavity and the electron beam. Each interaction cavity is also coupled to an adjacent cavity by means of a coupling aperture in the end wall defining the cavity. Generally, the coupling apertures between adjacent cavities are alternately disposed on opposite sides of the axis of the tube, although various other arrangements for staggering the coupling apertures are possible and have been employed. When the coupling apertures are so arranged, a folded waveguide type of energy propagation results, with the traveling-wave energy traversing the length of the tube by entering each interaction cavity from one side, crossing the electron beam and then leaving the cavity from the other side, thus traveling a sinuous, or serpentine, extended path.

Since the electron beam is projected along the axis of the tube through minimum sized holes in the end walls of the interaction cavities, the electron beam must be precisely constrained to its axial path in order to prevent excessive impingement of electrons on the slow-wave structure. Generally, this is accomplished by immersing the electron beam in a magnetic field which provides the required focusing so that the electron beam may pass as closely as possible to the slow-wave structure without excessive interception of electrons by the slow-wave structure.

A highly desirable focusing scheme from the standpoint of minimizing tube size and weight is periodic permanent magnet focusing in which a plurality of short annular permanent magnets are disposed in axial alignment along and about the slow-wave structure, with a plurality of annular ferromagnetic pole pieces interposed between and abutting adjacent magnets.

The magnets are magnetized axially and arranged with like poles of adjacent magnets confronting one another so that there is produced, along the axis of the tube, a periodic magnetic field of sinusoidal distribution, with zero field occurring at each pole piece and with a period equal to twice the pole piece spacing.

A further advance in the traveling-wave tube art involved the integration of periodic permanent magnet focusing with coupled cavity slow-wave structures of the type described above. The focusing means was brought inside the vacuum envelope for the tube by extending the pole pieces of the aforementioned periodic permanent magnet focusing arrangement radially inwardly to the immediate vicinity of the electron beam and by hermetically sealing between each pair of adjacent pole pieces an annular nonmagnetic spacer element which is disposed radially within each magnet. The radially inwardly projecting portions of the pole pieces serve as the end walls of the slow-wave structure interaction cavities, while the inner circumferential surfaces of the annular spacer elements define the lateral walls of the interaction cavities, thereby producing a combined slow-wave structure and magnetic focusing arrangement. Such an arrangement is disclosed in detail in U.S. Pat. No. 2,985,792, entitled "Periodically Focused Traveling-Wave Tube", issued May 23, 1961 to D. J. Bates et al. and assigned to the assignee of the present invention.

The design of coupled cavity traveling-wave tubes of the foregoing type for maximum bandwidth is a complex task involving optimization of a number of slow-wave structure and focusing arrangement parameters including the interaction cavity diameter and axial extent, the pole piece thickness, the size and configuration of the interaction cavity coupling apertures and the size of the electron beam holes in the pole pieces. In general, increasing the size of the coupling apertures and decreasing the interaction cavity diameter and the size of the electron beam holes will result in an increase in tube bandwidth. On the other hand, for a given operating voltage between the slow-wave structure and the cathode (electron beam voltage), a decrease in the size of the electron beam holes results in more stringent requirements on either the beam focusing arrangement or the electron gun which generates the beam, or both. In addition, the tube bandwidth usually varies inversely with the electron beam voltage, thereby reducing the maximum available output power as the bandwith is increased.

It is an object of the present invention to provide a traveling-wave tube coupled cavity slow-wave structure which, for a given electron beam voltage and beam hole size, provides a wider bandwidth than the prior art.

It is a further object of the invention to provide a wide bandwidth coupled cavity slow-wave structure for a traveling tube which, for a given electron beam voltage, utilizes larger electron beam holes than otherwise comparable previous slow-wave structures, thereby imposing less stringent requirements on the beam focusing arrangement and the electron gun.

It is still another object of the invention to provide a wide bandwidth coupled cavity traveling-wave tube which, for a given bandwidth, is operable with a higher electron beam voltage than in the prior art, thereby achieving higher output power over the same bandwidth.

A traveling-wave tube according to the invention includes means for providing a beam of electrons along a predetermined axis and a slow-wave structure for propagating electromagnetic wave energy in such manner that it can interact with the electron beam. The slow-wave structure defines a plurality of interaction cavities disposed sequentially along the predetermined axis and in electromagnetic interacting relationship with the electron beam. Each interaction cavity has an oblong configuration in a plane perpendiculr to the axis, the oblong configuration having a length-to-width ratio of a predetermined value between about 1.2 and about 1.6 The end walls separating adjacent interaction cavities define aligned circular holes in their central regions to provide a passage for the electron beam and further define respective coupling apertures in regions radially outwardly of the central regions for interconnecting adjacent interaction cavities. Each coupling aperture extends circumferentially about half way around the beam holes.

Additional objects, advantages and characteristic features of the present invention will become readily apparent from the following detailed description of preferred embodiments of the invention when considered in conjunction with the accompanying drawings wherein:

FIG. 2 is a cross-sectional view taken along line 2—2 of FIG. 1;

FIG. 3 is a longitudinal sectional view taken along line 3—3 of FIG. 2; and

FIG. 4 is a cross-sectional view similar to FIG. 2 illustrating a portion of a traveling-wave tube according to another embodiment of the invention.

Figure 1:
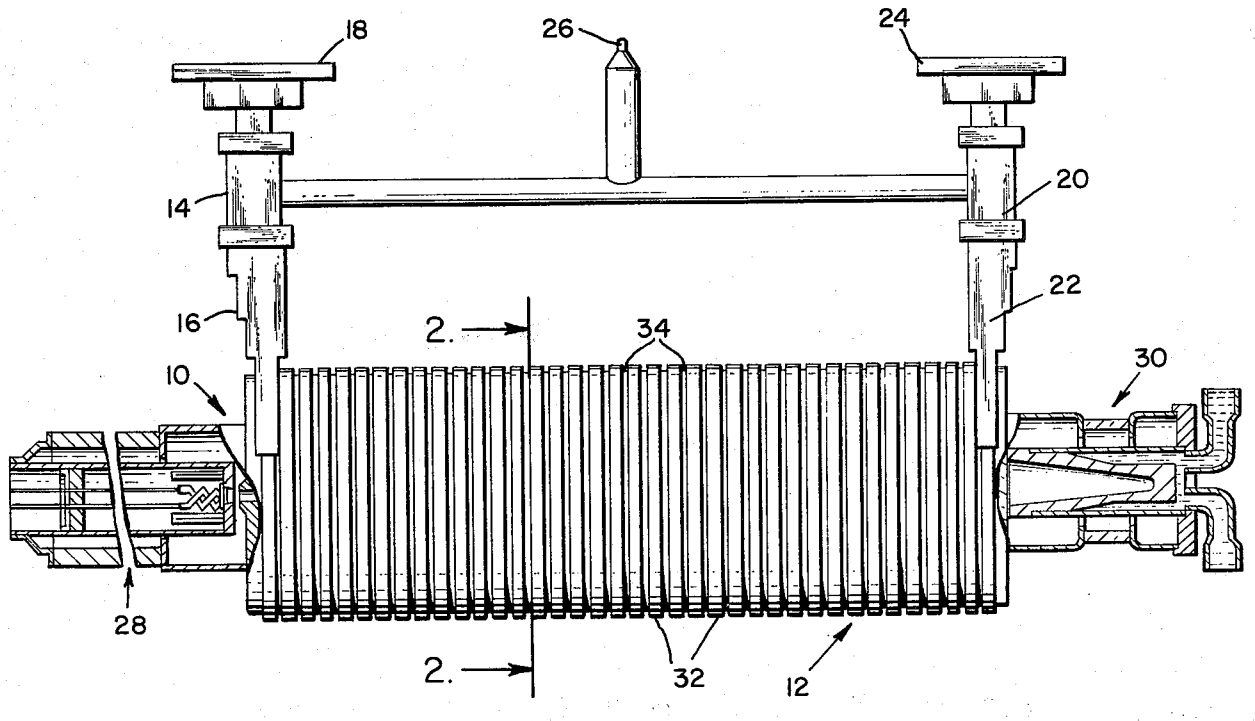
FIG. 1 is an overall view, partly in longitudianl section and partly broken away, illustrating a traveling-wave tube according to the invention.

Referring to the drawings with more particularity, in FIG. 1 the reference numeral 10 designates generally a traveling-wave tube which includes an arrangement 12 of magnets, pole pieces and spacer members which will be described in detail later. At this point it should suffice to state that the spacer members and interior portions of the pole pieces function as a slow-wave structure for propagating an electromagnetic wave with a phase velocity substantially less than he velocity of light, while the magnets and pole pieces constitute a periodic permanent magnet focusing device for focusing the electron beam traversing the length of the slow-wave structure.

Coupled to the input end of the arrangement 12 is an input waveguide transducer 14 which includes an impedance step transformer 16. A flange 18 is provided for coupling the assembled traveling-wave tube 10 to an external waveguide or other microwave transmission line (not shown). The construction of the flange 18 may include a microwave window (not shown) transparent to microwave energy but capable of maintaining a vacuum within the traveling-wave tube 10. At the output end of the arrangement 12 an output transducer 20 is provided which is substantially similar to the input transducer 14 and which includes an impedance step transformer 22 and a coupling flange 24, which elements are similar to the elements 16 and 18, respectively, of the input transducer 14. For vacuum pumping the traveling-wave 10 during manufacture, a double-ended pumping tube 26 may be connected to both of the input and output waveguide transducers 14 and 20.

An electron gun 28, disposed at one end of the traveling-wave tube 10, functions to launch a beam of electrons along longitudinal axis 29 of the tube 10 (FIG. 3). The electron gun 28 may be of any conventional construction well known in the art. For details as to the construction of an exemplary gun 28, reference may be made to the aforementioned U.S. Pat. No. 2,985,792 and U.S. Pat. No. 2,936,393, entitled "Low Noise Traveling-wave Tube", issued May 10, 1960 to M. R. Currie et al. and assigned to the assignee of the present invention.

At the opposite end of the traveling-wave tube 10 there is provided a cooled collector structure 30 for collecting the electrons in the beam. The collector 30 is conventional and may be of any form well known in the art. For details as to the construction of an exemplary collector 30, reference may be made to the forementioned U.S. Pat. No. 2,985,792 and U.S. Pat. No. 2,860,277, entitled "Traveling-Wave Tube Collector Electrode", issued Nov. 11, 1958 to A. H. Iversen and assigned to the assignee of the present invention.

The construction of the slow-wave structure and magnetic focusing arrangement for the traveling-wave tube 10 is illustrated in more detail in FIGS. 2 and 3. A plurality of apertured disk-shaped permanent magnets 32 are interposed between a plurality of ferromagnetic pole pieces 34. As illustrated in FIG. 2, the magnets 32 may be diametrically split into two sections **32*a*, and 32*b* for convenience during assembly of the tube. The ferromagnetic pole pieces 34 extend radially inwardly of the magnets 32 to approximately the perimeter of the region adapted to contain the axial electron beam. The individual pole pieces are constructed in such a manner that a short drift tube, or ferrule, 36 is provided at the inner extremity of each pole piece. The drift tube 36 is in the form of a cylindrical extension, or lip, protruding axially along the path of the electron beam from both surfaces of pole piece 34, i.e., in both directions normal to the plane of the pole piece 34. The drift tubes 36 are provided with central and axially aligned circular holes 38 to provide a passage for the flow of the electron beam. Adjacent ones of the drift tubes 36 are separated by a gap 40 which functions as a magnetic gap to provide a focusing lens for the electron beam and also as in interaction gap in which energy exchange between the electron beam and traveling-wave energy traversing the slow-wave structure occurs. The magnets 32 are stacked with alternating polarity along the axis 29 of the tube 10,** thus causing a reversal of the magnetic field at each magnetic lens and thereby providing a periodic focusing arrangement.

Disposed within each of the magnets 32 is a hollow slow-wave structure spacer member 42 of an electrically conductive nonmagnetic material such as copper. Each spacer member 42 defines an aperture 44 therethrough to provide space for a microwave interaction cell, or cavity, 46 which is defined by the inner lateral surface of the spacer member 42 and the walls of the two adjacent pole pieces 34 projecting inwardly of the member 42. As shown in FIG. 2, each spacer aperture 44 has an oblong configuration of length L and width W in a plane perpendicular to the axis 29 of the traveling-wave tube 10. The ratio of the aperture length L to the width W is of a predetermined value ranging between about 1.2 and about 1.6, a specific exemplary length-to-width ratio L/W in a preferred embodiment of the invention being about 1.5. As is further shown in FIG. 2, the end portions of oblong aperture 44 have a substantially semicircular configuration in a plane perpendicular to the tube axis In order to interconnect adjacent interaction cavities 46 an off-axis coupling aperture 48 is provided through each of the pole pieces 34 to permit the transfer of electromagnetic wave energy from cavity to cavity. Each coupling aperture 48 extends radially from substantially the outer circumferential surface of the adjacent drift tube 36 to substantially the periphery of the adjacent interaction cavities 46 and extends circumferentially about half way around the electron beam holes 38. Preferably, the circumferential extremities of the coupling apertures 48 lie substantially parallel to the direction of the length L of the interaction cavities 46. As shown in FIG. 3, successive coupling apertures 48 are alternately disposed on opposite sides of the tube axis 29, although other arrangements for staggering the coupling apertures 48 also may be employed. In any event, it will be apparent that the spacer members 42 and the portions of the pole pieces 34 projecting inwardly of the spacer members 42 not only form an envelope for the tube, but also constitute a slow-wave structure for propagating traveling-wave energy in a serpentine path along the axially traveling electron beam so as to support energy exchange between the electrons of the beam and the traveling wave.

Another embodiment of the invention is illustrated in FIG. 4. Components in the embodiment of FIG. 4 which correspond to respective components in the embodiment of FIG. 2 are designated by the same second and third reference numeral digits as their counterpart components in FIG. 2, along with the addition of a prefix numeral 1. The embodiment of FIG. 4 differs from that of FIG. 2 in that oblong apertures 144 defined by spacer members 142 have a substantially rectangular configuration in a plane perpendicular to the tube axis, in contrast to possessing the substantially semicircular end portions shown in FIG. 2. The substantially rectangular configuration of FIG. 4 provides a slightly wider bandwidth than a similarly dimensioned configuration as illustrated in FIG. 2.

As a specific example for illustrative purposes, a traveling-wave tube according to FIGS. 1–3 and designed to operate with a center frequency of 9 GHz and an electron beam voltage of 33 Kv may be constructed with the following exemplary dimensions:

| Parameter | Dimension (inches) |
|---|---|
| Length L of oblong apertures 44 | 0.470 |
| Width W of oblong apertures 44 | 0.310 |
| Radius of curvature of semicircular end portions of apertures 44 | 0.155 |
| Axial extent of interaction cavities 46 | 0.200 |
| Thickness of pole pieces 34 | 0.120 |
| Diameter of drift tubes 36 | 0.210 |
| Diameter of drift tube holes 38 | 0.156 |
| Axial extent of drift tubes 36 | 0.270 |
| Axial extent of interaction gaps 40 | 0.050 |

A traveling-wave tube constructed according to FIGS. 1–3 with the foregoing exemplary dimensions and employing permanent magnets 32 of Alnico 8 has been operated successfully over a 44% bandwidth from 7 GHz to 11 GHz. Moreover, test data from a slow-wave structure constructed as shown in FIGS. 2–3 (with a cavity length $L = 0.62$ inch and a cavity width $W = 0.42$ inch) and a similarly dimensioned prior art slow-wave structure employing circular interaction cavities (having a cavity diameter of 0.52 inch) has demonstrated an increase in bandwidth from 5 GHz for the prior art arrangement to 5.6 GHz when using the arrangement according to the invention. Thus, for a given electron beam voltage and beam hole size, it will be apparent that a traveling-wave tube according to the invention provides a wider bandwidth than the prior art.

In addition, a number of other advantages result from the present invention. For a given electron beam voltage, a slow-wave structure according to the invention can be constructed with larger electron beam holes than otherwise comparable slow-wave structures of the prior art. Thus, for a traveling-wave tube utilizing periodic permanent magnet focusing, the required peak magnetic field can be lower, resulting in a better collimated electron beam with increased beam transmission through the slow-wave structure. Alternatively, with the same magnetic focusing design, the cross-sectional area of the electron beam may be increased, thereby increasing the beam current and achieving higher output power from the traveling-wave tube. Also, for some applications less expensive Alnico 8 focusing magnets may be used instead of more expensive samarium cobalt magnets.

As a further alternative, by increasing the beam cross-sectional area without changing the beam current, a smaller beam current density may be achieved. This enables the electron gun to be designed with either a smaller cathode current density or with less beam area compression, thereby increasing cathode life.

As a still further alternative, for a given bandwidth, a traveling-wave tube according to the invention may be operated with a higher electron beam voltage than in the prior art. This increases the available beam power, enabling higher output power to be achieved without sacrificing bandwidth.

Although the present invention has been shown and described with reference to particular embodiments, nevertheless various changes and modifications which are obvious to a person skilled in the art to which the invention pertains are deemed to lie within the spirit, scope and contemplation of the invention.

What is claimed is:

1. A traveling-wave tube comprising:

means for providing a beam of electrons along a predetermined axis;

slow wave structure means for propagating electromagnetic wave energy in such manner that it can interact with said beam of electrons, said slow-wave structure means defining a plurality of interaction cavities disposed sequentially along said axis and in electromagnetic interacting relationship with said beam of electrons, each of said cavities having an oblong configuration in a plane perpendicular to said axis, said oblong configuration having a length-to-width ratio of a predetermined value between about 1.2 and about 1.6;

the end walls separating adjacent ones of said cavities defining aligned circular holes in their central regions to provide a passage for said beam of electrons and further defining respective coupling apertures in regions radially outwardly of said central regions for interconnecting adjacent cavities, and each said coupling aperture extending circumferentially about half way around said aligned circular holes.

2. A traveling-wave tube according to claim 1 wherein the circumferential extremities of said coupling apertures lie substantially parallel to the length of said interaction cavities.

3. A traveling-wave tube according to claim 1 wherein a drift tube is disposed coaxially about each of said circular holes, and each of said coupling aperture extends radially from substantially the outer circumferential surface of the said drift tube to substantially the periphery of the adjacent interaction cavities.

4. A traveling-wave tube according to claim 1 wherein the value of said length-to-width ratio is about 1.5.

5. A traveling-wave tube according to claim 1 wherein the ends of said oblong configuration are substantially semicircular.

6. A traveling-wave tube according to claim 1 wherein said oblong configuration is substantially rectangular.

* * * * *